US006293359B1

(12) United States Patent
Dobran et al.

(10) Patent No.: US 6,293,359 B1
(45) Date of Patent: Sep. 25, 2001

(54) PRESSURE CONTROL OF A DRILLING APPARATUS

(75) Inventors: Mauro F. Dobran; Georges J. Desrosiers; James Wilfred McIvor, all of Winnipeg (CA)

(73) Assignee: Cubex Limited, Winnipeg (CA)

( * ) Notice: Subject to any disclaimer, the term of this patent is extended or adjusted under 35 U.S.C. 154(b) by 0 days.

(21) Appl. No.: 09/586,929

(22) Filed: Jun. 5, 2000

(51) Int. Cl.[7] ..... E21B 15/00
(52) U.S. Cl. ..... 175/195; 173/147
(58) Field of Search ..... 175/170, 220, 175/173, 40, 189, 162, 195, 27, 52; 173/28, 147, 195, 213

(56) References Cited

U.S. PATENT DOCUMENTS 3,867,989 * 2/1975 Hisey et al. ..... 173/147
4,449,592 * 5/1984 Mayer ..... 175/52
6,186,248 * 2/2001 Silay et al. ..... 175/27

* cited by examiner

*Primary Examiner*—Robert E. Pezzuto
(74) *Attorney, Agent, or Firm*—Adrian D. Battison; Michael R. Williams

(57) ABSTRACT

Apparatus for blast hole drilling includes a hammer and drill bit driven by a hydraulic drive motor outside the hole through a drill string extending along the drilled hole to the drill bit. The drive motor is carried on a mast with a telescopic hydraulic cylinder driving the motor along the mast in a forward direction for forwarding the drill bit along the hole to the rock face and for applying a feed force on the drill bit at the rock face and in a rearward direction for reducing the feed force and for withdrawing the drill bit from the hole. The cylinder assembly has a pulldown pressure side fed at a constant supply rate and a holdback pressure side controlled to discharge the fluid when moving downwards and to supply the fluid at a constant rate when pulling up. The control system includes a first valve for controlling a rate of supply of fluid to the motor for controlling the rate of rotation of the drill bit, a drilling valve operable to supply fluid to the pulldown side or to the holdback side, a second valve for controlling the rate of supply of fluid to the pulldown side, a third valve for controlling the rate of discharge of fluid from the holdback side, a hydraulic feedback line for communicating an increase in pressure of the fluid at the motor, caused by an increase in resistance to the rotation of the drill bit, to the holdback side of the so that the rate of forward movement of the drill bit is varied in proportion to changes in the pressure at the motor and a pressure switch responsive to pressure of the fluid at the hydraulic drive assembly exceeding a predetermined pressure limit to repeatedly cycle an upward and downward movement of the drill bit until the overpressure condition clears or until a number of cycles is completed.

15 Claims, 2 Drawing Sheets

Hydraulic and Electrical Controls

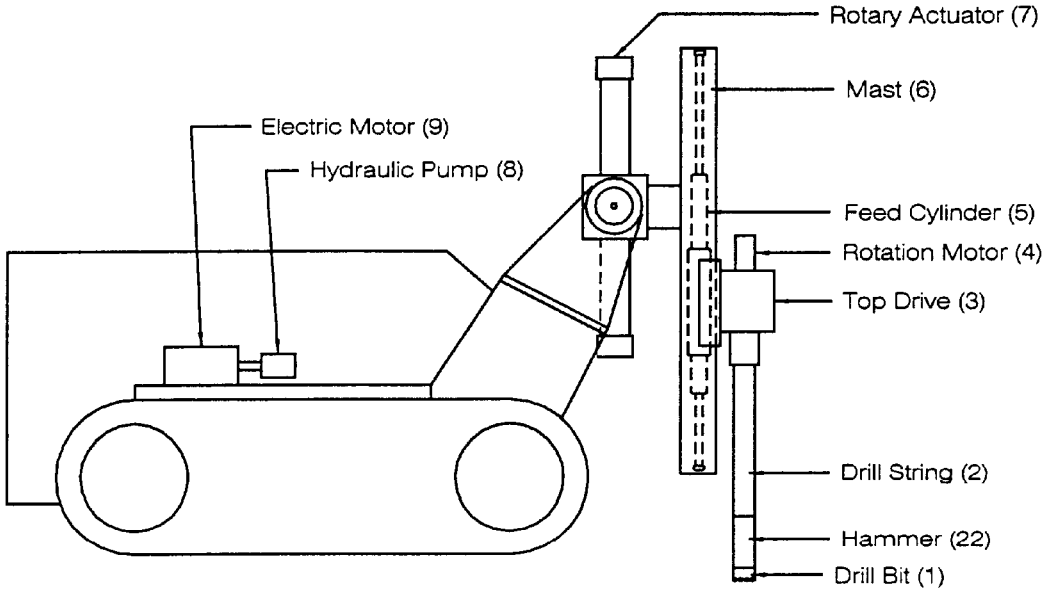
Figure 1: Typical Illustration of a DTH Drill

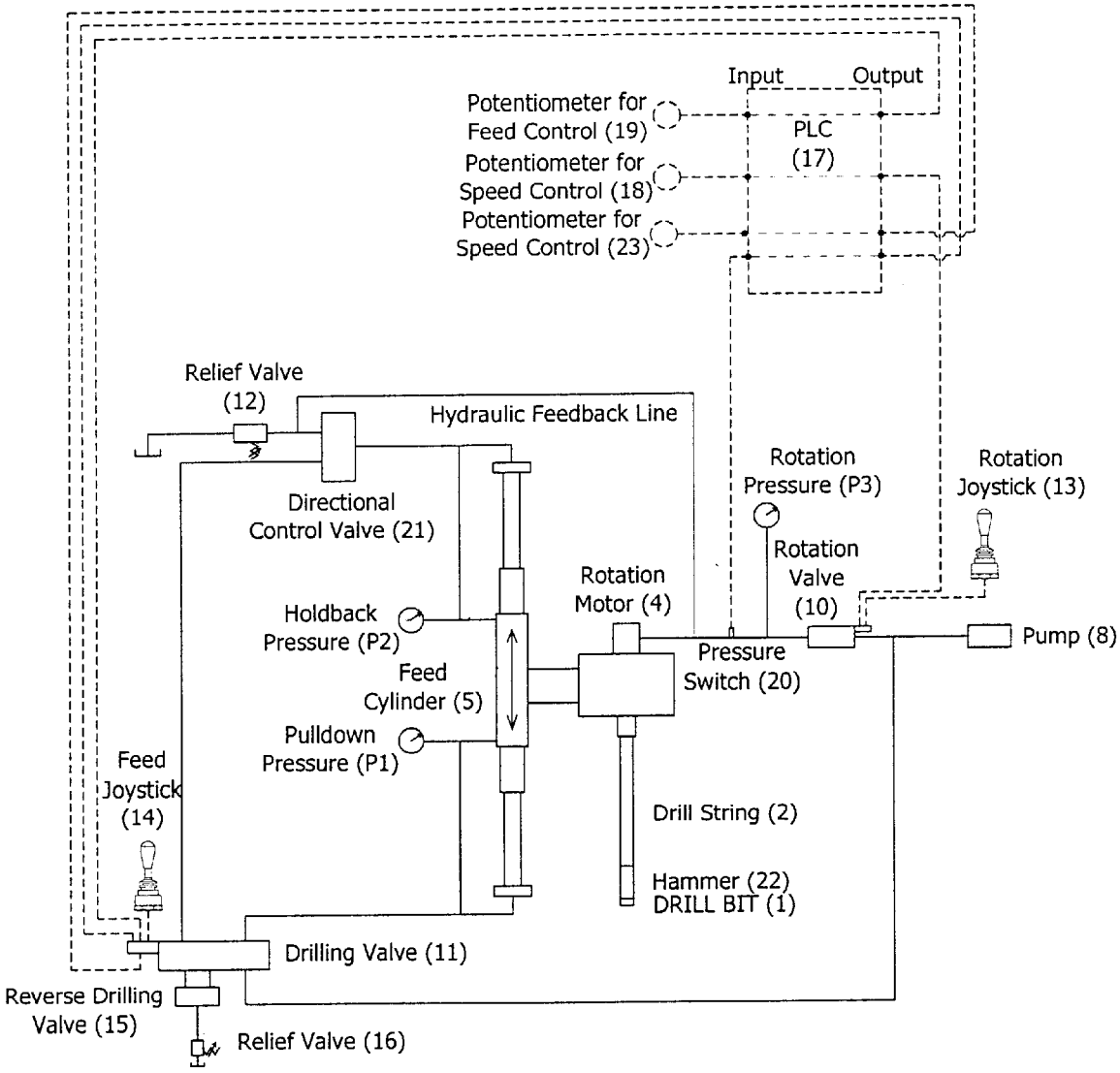
Figure 2: Hydraulic and Electrical Controls

PRESSURE CONTROL OF A DRILLING APPARATUS

This invention relates to a drilling apparatus and particularly to an improved control system which controls force on the drill bit.

BACKGROUND OF THE INVENTION

The present invention is primarily but not exclusively concerned with drilling of holes for receiving explosives in a blast hole operation. One of the primary objectives of blast hole drilling is to produce straight holes and to increase drill bit life. For uniform breaking of a rock mass in the resulting explosion, it is important to have blast holes that are straight and accurately positioned. Production of straight holes depends on the feed force, rotation speed and torque applied through a "down the hole" (DTH) "in the hole" (ITH) percussion hammer to a drill bit. These drilling parameters are set according to the geological conditions of the rock mass.

SUMMARY OF THE INVENTION

It is one object of the present invention to provide a drilling apparatus aimed at the production of straight holes by a drill.

According to a first aspect of the invention there is provided a drilling apparatus comprising:

a drill bit operable to break rock to produce a hole in a forward direction;

a hydraulic drive assembly arranged to be mounted exteriorly of the hole for communicating drive force to the drill bit;

a drill string attached to and supported by the drive assembly for extending from the drive assembly along the drilled hole to the drill bit;

a mast for supporting the drive assembly for movement of the drive assembly with the drill string and the drill bit carried thereby in a direction longitudinally of the hole;

a hydraulic cylinder assembly for causing movement of the drive assembly along the mast in a forward direction for forwarding the drill bit along the hole to the rock face and for applying a feed force on the drill bit at the rock face and in a rearward direction for reducing the feed force and for withdrawing the drill bit from the hole;

the hydraulic cylinder assembly having a pulldown pressure side and a holdback pressure side arranged such that the supply of fluid under pressure to the pulldown pressure side tends to move the drive assembly in the forward direction and to cause discharge of fluid from the holdback side and the supply of fluid under pressure to the holdback pressure side tends to move the drive assembly in the rearward direction and to cause discharge of fluid from the pulldown side so that a resultant force on the drive assembly in the forward and rearward directions is dependent upon the pressure differential between the pulldown and holdback sides;

and a control system for controlling the rotation rate of the drill bit and the feed force on the drill bit, the control system comprising:

a first valve for controlling a rate of supply of fluid to the hydraulic drive assembly for controlling the rate of rotation of the drill bit;

a second valve for controlling a rate of supply of fluid to the pulldown side of the hydraulic cylinder assembly for controlling the rate of movement of the drill bit in the forward direction;

a third valve for controlling a rate of discharge of fluid from the holdback side of the hydraulic cylinder assembly;

a control unit for controlling the first and second valves having a first input for setting a selected rate of rotation of the drill bit and a second input for setting a selected rate of forwarding movement of the drill bit;

and a hydraulic feedback line for communicating an increase in pressure of the fluid at the hydraulic drive assembly, caused by an increase in resistance to the rotation of the drill bit, to the holdback side of the hydraulic cylinder assembly such that the rate of forward movement of the drill bit is varied in proportion to changes in the pressure of the fluid at the hydraulic drive assembly.

Preferably the percussion hammer causes forward and rearward reciprocation of the hammer piston to apply percussive force to the drill bit.

Preferably the holdback side is connected to a directional control valve movable between a first position in which the fluid from the hydraulic cylinder assembly is discharged to the third valve and to a second position in which fluid from a supply valve is directed to the hydraulic cylinder assembly for driving rearward movement of the drill bit.

Preferably the hydraulic feedback line is connected to the holdback side between the directional control valve and the third valve.

Preferably the control system includes a third input for rearward movement of the drill bit.

Preferably the control system further includes a pressure switch responsive to pressure of the fluid at the hydraulic drive assembly exceeding a predetermined pressure limit and wherein the control system is arranged in response to exceeding said limit to effect supply of fluid to the holdback side to drive rearward movement of the drill bit.

Preferably the control system is arranged to drive said rearward movement for a predetermined time and then to supply fluid to the pulldown side to drive forward movement of the drill bit.

Preferably the control system is arranged to repeat the rearward movement and the forward movement over a set number of cycles and then to halt said movements in the event that the pressure continues to reach said limit.

According to a second aspect of the invention there is provided a drilling apparatus comprising:

a drill bit operable to break rock to produce a hole in a forward direction;

a hydraulic drive assembly arranged to be mounted exteriorly of the hole for communicating drive force to the drill bit;

a drill string attached to and supported by the drive assembly for extending from the drive assembly along the drilled hole to the drill bit;

a mast for supporting the drive assembly for movement of the drive assembly with the drill string and the drill bit carried thereby in a direction longitudinally of the hole;

a hydraulic cylinder assembly for causing movement of the drive assembly along the mast in a forward direction for forwarding the drill bit along the hole to the rock face and for applying a feed force on the drill bit at the rock face and in a rearward direction for reducing the feed force and for withdrawing the drill bit from the hole;

the hydraulic cylinder assembly having a pulldown pressure side and a holdback pressure side arranged such that the supply of fluid under pressure to the pulldown pressure side tends to move the drive assembly in the forward direction and to cause discharge of fluid from the holdback side and the supply of fluid under pressure to the holdback pressure side tends to move the drive assembly in the rearward direction and to cause discharge of fluid from the pulldown side so that a resultant force on the drive assembly in the forward and rearward directions is dependent upon the pressure differential between the pulldown and holdback sides;

and a control system for controlling the rotation rate of the drill bit and the feed force on the drill bit, the control system comprising:

a first valve for controlling a rate of supply of fluid to the hydraulic drive assembly for controlling the rate of rotation of the drill bit;

a drilling valve operable into two positions for controlling supply of fluid to the pulldown side and to the holdback side respectively so as to control forward and rearward movement of the drill bit respectively a second valve for controlling a rate of supply of fluid to the pulldown side for controlling the rate of movement of the drill bit in the forward direction;

a third valve for controlling a rate of discharge of fluid from the holdback side of the hydraulic cylinder assembly;

a control unit for controlling the drilling valve and the first and second valves, the control unit having a first input for setting a selected rate of rotation of the drill bit and a second input for setting a selected rate of forwarding movement of the drill bit;

a hydraulic feedback line for communicating an increase in pressure of the fluid at the hydraulic drive assembly, caused by an increase in resistance to the rotation of the drill bit, to the holdback side of the hydraulic cylinder assembly such that the rate of forward movement of the drill bit is varied in proportion to changes in the pressure of the fluid at the hydraulic drive assembly;

and a pressure switch responsive to pressure of the fluid at the hydraulic drive assembly exceeding a predetermined pressure limit;

the control system being arranged in response to the pressure exceeding said limit to effect supply of fluid to the holdback side to drive rearward movement of the drill bit, to drive said rearward movement for a predetermined time and then to supply fluid to the pulldown side to drive forward movement of the drill bit.

According to a third aspect of the invention there is provided a method for drilling comprising:

providing a drill bit operable to break rock to produce a hole in a forward direction;

providing a hydraulic drive assembly arranged to be mounted exteriorly of the hole for communicating drive force to the drill bit;

providing a drill string attached to and supported by the drive assembly for extending from the drive assembly along the drilled hole to the drill bit;

providing a mast for supporting the drive assembly for movement of the drive assembly with the drill string and the drill bit carried thereby in a direction longitudinally of the hole;

providing a hydraulic cylinder assembly for causing movement of the drive assembly along the mast in a forward direction for forwarding the drill bit along the hole to the rock face and for applying a feed force on the drill bit at the rock face and in a rearward direction for reducing the feed force and for withdrawing the drill bit from the hole;

the hydraulic cylinder assembly having a pulldown pressure side and a holdback pressure side arranged such that the supply of fluid under pressure to the pulldown pressure side tends to move the drive assembly in the forward direction and to cause discharge of fluid from the holdback side and the supply of fluid under pressure to the holdback pressure side tends to move the drive assembly in the rearward direction and to cause discharge of fluid from the pulldown side so that a resultant force on the drive assembly in the forward and rearward directions is dependent upon the pressure differential between the pulldown and holdback sides;

and controlling the rotation rate of the drill bit and the feed force on the drill bit by:

controlling a rate of supply of fluid to the hydraulic drive assembly for controlling the rate of rotation of the drill bit;

controlling a rate of supply of fluid to the pulldown side of the hydraulic cylinder assembly for controlling the rate of movement of the drill bit in the forward direction;

controlling a rate of discharge of fluid from the holdback side of the hydraulic cylinder assembly;

controlling the first and second valves to select a rate of rotation of the drill bit and to select a rate of forwarding movement of the drill bit;

and communicating an increase in pressure of the fluid at the hydraulic drive assembly, caused by an increase in resistance to the rotation of the drill bit, to the holdback side of the hydraulic cylinder assembly such that the rate of forward movement of the drill bit is varied in proportion to changes in the pressure of the fluid at the hydraulic drive assembly.

The arrangement as described herein has two main functions: a) automatic control of feed force, rotation speed and torque according to the resistance encountered by the drill bit, and b) prevent the drill bit from jamming. It is supplied as an added feature along with manual controls. The main components of the arrangement as described herein are rotation and feed control interfaces, a rotation pressure monitoring device, and a PLC. A ladder logic program and hydraulic feedback are used to control all intended functions.

BRIEF DESCRIPTION OF THE DRAWINGS

One embodiment of the invention will now be described in conjunction with the accompanying drawings in which:

FIG. 1 is a side elevational view of a typical drilling apparatus according to the present invention.

FIG. 2 is a schematic illustration of the operating components and the control system of the apparatus of FIG. 1.

DETAILED DESCRIPTION

FIG. 1 illustrates a in the hole (ITH) drill. The rotation motor 4 rotates the drill string 2 and the drill bit 1 through the top drive assembly 3 at a predetermined RPM. The drill bit 1 is advanced into a rock mass by the feed cylinder 5. It breaks rocks due to percussive actions of the hammer 22. Forces exerted on the bit can be varied either by the operator or by the arrangement as described herein. The hydraulic pump 8, driven by a motor 9, is the source of energy for the rotation motor 4 and the feed cylinder 5.

The feed cylinder 5 is a compound or telescopic cylinder where two inputs are provided on the pulldown side and two inputs are provided on the holdback side so that compound movement of the main body 5A on the main mast 5B occurs from the top to the bottom of the mast.

Feed force, rotation speed and torque are set and maintained by means of hydraulic valves and electrical controls shown in FIG. 2. The rotation valve 10 controls rotation speed and the drilling valve 11 controls feed rate. The amount of feed force and torque on rocks depends on the differential pressure between the pulldown pressure P1 and the holdback pressure P1. The pulldown pressure P1 is the supply line pressure to the feed cylinder 5 tending to move the portion 5A downwardly on the mast and it usually remains unchanged during drilling. The holdback pressure P2 tending to move the portion 5A upwardly on the mast is the return line pressure of the feed cylinder 5 and it is usually adjusted either manually or automatically by the control system.

When the drill is intended to be used in manual mode, the control system is turned off, the pulldown pressure P1 is set at a predetermined level by adjusting the relief valve 16. The holdback pressure P2 is controlled by the relief valve 12. The joysticks 13 and 14 are used to control the rotation valve 10 and the drilling valve 11 respectively.

When the control system is turned on, feed force, rotation speed and torque are set by the potentiometers 18 and 19 respectively. The PLC 17 receives a preset level of signal from the potentiometer 18 and accordingly energizes the coil of the rotation valve 10. Rotation speed remains at this set value until it is changed by the potentiometer 18.

Maximum feed rate is set by the potentiometer 19, which sends signal to the PLC 17 to energize the drilling valve 11 accordingly.

The hydraulic feedback line and the directional control valve 21 allow the holdback pressure P2 to vary in direct proportion to the rise or fall of the rotation pressure P3. If the drill bit 1 encounters greater resistance, then the rotation pressure P3 will increase causing the holdback pressure P2 to increase and feed force and torque to decrease proportionately. This control of feed force helps maximize the drill bit life.

The pressure switch 20 monitors the rotation pressure P3 and sends a signal to the PLC 17 to energize the reverse feed coil of the drilling valve 11 once the rotation pressure P3 reaches the preset limit. The feed cylinder 5 retracts to withdraw the drill bit 1 from engagement at a speed set by the Potentiometer 23. Once the preset time is elapsed, the PLC 17 resets the drilling valve 11 to resumes drilling again. This drilling and reversing will continue until any one of the following conditions is met: a) rotation pressure drops below the preset limit, b) drilling and reversing cycles exceeds the preset value, and c) the drill operator shuts off the control system.

The control system responds very quickly to the geological conditions of the rock mass. It decreases feed force and rotation torque when drilling in harder rocks and prevents over feeding in broken rocks or voids. As a result of this, arrangement as described herein has been proven to be an effective control system for producing straight holes with minimal drill bit wear.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A drilling apparatus comprising:

a drill bit operable to break rock to produce a hole in a forward direction;

a hydraulic drive assembly arranged to be mounted exteriorly of the hole for communicating drive force to the drill bit;

a drill string attached to and supported by the drive assembly for extending from the drive assembly along the drilled hole to the drill bit;

a mast for supporting the drive assembly for movement of the drive assembly with the drill string and the drill bit carried thereby in a direction longitudinally of the hole;

a hydraulic cylinder assembly for causing movement of the drive assembly along the mast in a forward direction for forwarding the drill bit along the hole to the rock face and for applying a feed force on the drill bit at the rock face and in a rearward direction for reducing the feed force and for withdrawing the drill bit from the hole;

the hydraulic cylinder assembly having a pulldown pressure side and a holdback pressure side arranged such that the supply of fluid under pressure to the pulldown pressure side tends to move the drive assembly in the forward direction and to cause discharge of fluid from the holdback side and the supply of fluid under pressure to the holdback pressure side tends to move the drive assembly in the rearward direction and to cause discharge of fluid from the pulldown side so that a resultant force on the drive assembly in the forward and rearward directions is dependent upon the pressure differential between the pulldown and holdback sides;

and a control system for controlling the rotation rate of the drill bit and the feed force on the drill bit, the control system comprising:

a first valve for controlling a rate of supply of fluid to the hydraulic drive assembly for controlling the rate of rotation of the drill bit;

a second valve for controlling a rate of supply of fluid to the pulldown side of the hydraulic cylinder assembly for controlling the rate of movement of the drill bit in the forward direction;

a third valve for controlling a rate of discharge of fluid from the holdback side of the hydraulic cylinder assembly;

a control unit for controlling the first and second valves having a first input for setting a selected rate of rotation of the drill bit and a second input for setting a selected rate of forwarding movement of the drill bit;

and a hydraulic feedback line for communicating an increase in pressure of the fluid at the hydraulic drive assembly, caused by an increase in resistance to the rotation of the drill bit, to the holdback side of the hydraulic cylinder assembly such that the rate of forward movement of the drill bit is varied in proportion to changes in the pressure of the fluid at the hydraulic drive assembly.

2. The drilling apparatus according to claim 1 wherein the drill bit includes a percussion hammer operable to cause forward and rearward reciprocation of a hammer piston to apply percussive force to the drill bit.

3. The drilling apparatus according to claim 1 wherein the holdback side is connected to a directional control valve movable between a first position in which the fluid from the hydraulic cylinder assembly is discharged to the third valve and to a second position in which fluid from a supply valve is directed to the hydraulic cylinder assembly for driving rearward movement of the drill bit.

4. The drilling apparatus according to claim 3 wherein the hydraulic feedback line is connected to the holdback side between the directional control valve and the third valve.

5. The drilling apparatus according to claim 3 wherein the control system includes a third input for selecting a speed of rearward movement of the drill bit.

6. The drilling apparatus according to claim 1 wherein the control system further includes a pressure switch responsive to pressure of the fluid at the hydraulic drive assembly exceeding a predetermined pressure limit and wherein the control system is arranged in response to exceeding said limit to effect supply of fluid to the holdback side to drive rearward movement of the drill bit.

7. The drilling apparatus according to claim 6 wherein the control system is arranged to drive said rearward movement for a predetermined time and then to supply fluid to the pulldown side to drive forward movement of the drill bit.

8. The drilling apparatus according to claim 7 wherein the control system is arranged to repeat the rearward movement and the forward movement over a set number of cycles and then to halt said movements in the event that the pressure continues to reach said limit.

9. A drilling apparatus comprising:

a drill bit operable to break rock to produce a hole in a forward direction;

a hydraulic drive assembly arranged to be mounted exteriorly of the hole for communicating drive force to the drill bit;

a drill string attached to and supported by the drive assembly for extending from the drive assembly along the drilled hole to the drill bit;

a mast for supporting the drive assembly for movement of the drive assembly with the drill string and the drill bit carried thereby in a direction longitudinally of the hole;

a hydraulic cylinder assembly for causing movement of the drive assembly along the mast in a forward direction for forwarding the drill bit along the hole to the rock face and for applying a feed force on the drill bit at the rock face and in a rearward direction for reducing the feed force and for withdrawing the drill bit from the hole;

the hydraulic cylinder assembly having a pulldown pressure side and a holdback pressure side arranged such that the supply of fluid under pressure to the pulldown pressure side tends to move the drive assembly in the forward direction and to cause discharge of fluid from the holdback side and the supply of fluid under pressure to the holdback pressure side tends to move the drive assembly in the rearward direction and to cause discharge of fluid from the pulldown side so that a resultant force on the drive assembly in the forward and rearward directions is dependent upon the pressure differential between the pulldown and holdback sides;

and a control system for controlling the rotation rate of the drill bit and the feed force on the drill bit, the control system comprising:

a first valve for controlling a rate of supply of fluid to the hydraulic drive assembly for controlling the rate of rotation of the drill bit;

a drilling valve operable into two positions for controlling supply of fluid to the pulldown side and to the holdback side respectively so as to control forward and rearward movement of the drill bit respectively a second valve for controlling a rate of supply of fluid to the pulldown side for controlling the rate of movement of the drill bit in the forward direction;

a third valve for controlling a rate of discharge of fluid from the holdback side of the hydraulic cylinder assembly;

a control unit for controlling the drilling valve and the first and second valves, the control unit having a first input for setting a selected rate of rotation of the drill bit and a second input for setting a selected rate of forwarding movement of the drill bit;

a hydraulic feedback line for communicating an increase in pressure of the fluid at the hydraulic drive assembly, caused by an increase in resistance to the rotation of the drill bit, to the holdback side of the hydraulic cylinder assembly such that the rate of forward movement of the drill bit is varied in proportion to changes in the pressure of the fluid at the hydraulic drive assembly;

and a pressure switch responsive to pressure of the fluid at the hydraulic drive assembly exceeding a predetermined pressure limit;

the control system being arranged in response to the pressure exceeding said limit to effect supply of fluid to the holdback side to drive rearward movement of the drill bit, to drive said rearward movement for a predetermined time and then to supply fluid to the pulldown side to drive forward movement of the drill bit.

10. The drilling apparatus according to claim 9 wherein the drill bit includes a percussion hammer operable to cause forward and rearward reciprocation of a hammer piston to apply percussive force to the drill bit.

11. The drilling apparatus according to claim 9 wherein the holdback side is connected to a directional control valve movable between a first position in which the fluid from the hydraulic cylinder assembly is discharged to the third valve and to a second position in which fluid from a supply valve is directed to the hydraulic cylinder assembly for driving rearward movement of the drill bit.

12. The drilling apparatus according to claim 11 wherein the hydraulic feedback line is connected to the holdback side between the directional control valve and the third valve.

13. The drilling apparatus according to claim 12 wherein the control system includes a third input for selecting a speed of rearward movement of the drill bit.

14. The drilling apparatus according to claim 9 wherein the control system is arranged to repeat the rearward movement and the forward movement over a set number of cycles and then to halt said movements in the event that the pressure continues to reach said limit.

15. A method for drilling comprising:

providing a drill bit operable to break rock to produce a hole in a forward direction;

providing a hydraulic drive assembly arranged to be mounted exteriorly of the hole for communicating drive force to the drill bit;

providing a drill string attached to and supported by the drive assembly for extending from the drive assembly along the drilled hole to the drill bit;

providing a mast for supporting the drive assembly for movement of the drive assembly with the drill string and the drill bit carried thereby in a direction longitudinally of the hole;

providing a hydraulic cylinder assembly for causing movement of the drive assembly along the mast in a forward direction for forwarding the drill bit along the hole to the rock face and for applying a feed force on the drill bit at the rock face and in a rearward direction for reducing the feed force and for withdrawing the drill bit from the hole;

the hydraulic cylinder assembly having a pulldown pressure side and a holdback pressure side arranged such that the supply of fluid under pressure to the pulldown pressure side tends to move the drive assembly in the forward direction and to cause discharge of fluid from the holdback side and the supply of fluid under pressure to the holdback pressure side tends to move the drive assembly in the rearward direction and to cause discharge of fluid from the pulldown side so that a resultant force on the drive assembly in the forward and rearward directions is dependent upon the pressure differential between the pulldown and holdback sides;

and controlling the rotation rate of the drill bit and the feed force on the drill bit by:

controlling a rate of supply of fluid to the hydraulic drive assembly for controlling the rate of rotation of the drill bit;

controlling a rate of supply of fluid to the pulldown side of the hydraulic cylinder assembly for controlling the rate of movement of the drill bit in the forward direction;

controlling a rate of discharge of fluid from the holdback side of the hydraulic cylinder assembly;

controlling the first and second valves to select a rate of rotation of the drill bit and to select a rate of forwarding movement of the drill bit;

and communicating an increase in pressure of the fluid at the hydraulic drive assembly, caused by an increase in resistance to the rotation of the drill bit, to the holdback side of the hydraulic cylinder assembly such that the rate of forward movement of the drill bit is varied in proportion to changes in the pressure of the fluid at the hydraulic drive assembly.

* * * * *